US007766715B2

(12) United States Patent
Morita

(10) Patent No.: US 7,766,715 B2
(45) Date of Patent: Aug. 3, 2010

(54) METHOD OF MANUFACTURING PLASMA DISPLAY PANEL AND SETTER FOR SUBSTRATE USED THEREIN

(75) Inventor: Makoto Morita, Hyogo (JP)

(73) Assignee: Panasonic Corporation, Osaka (JP)

( * ) Notice: Subject to any disclaimer, the term of this patent is extended or adjusted under 35 U.S.C. 154(b) by 476 days.

(21) Appl. No.: 11/910,108

(22) PCT Filed: Feb. 13, 2007

(86) PCT No.: PCT/JP2007/052469

§ 371 (c)(1),
(2), (4) Date: Sep. 28, 2007

(87) PCT Pub. No.: WO2007/094290

PCT Pub. Date: Aug. 23, 2007

(65) Prior Publication Data

US 2008/0274661 A1 Nov. 6, 2008

(30) Foreign Application Priority Data

Feb. 14, 2006 (JP) ..... 2006-036343

(51) Int. Cl.
*H01J 9/26* (2006.01)
*H01J 9/46* (2006.01)

(52) U.S. Cl. ..... 445/25; 445/66

(58) Field of Classification Search ..... 445/24–25, 445/66, 70, 73; 313/582–587
See application file for complete search history.

(56) References Cited

U.S. PATENT DOCUMENTS

| | | | | |
|---|---|---|---|---|
| 6,160,345 | A | 12/2000 | Tanaka et al. | |
| 2002/0034917 | A1 | 3/2002 | Tanaka et al. | |
| 2002/0036466 | A1 | 3/2002 | Tanaka et al. | |
| 2004/0198130 | A1 * | 10/2004 | Tsuji et al. | 445/24 |

FOREIGN PATENT DOCUMENTS

| | | | |
|---|---|---|---|
| JP | 3-223167 | A | 10/1991 |
| JP | 2002-114537 | A | 4/2002 |
| JP | 2003-338248 | A | 11/2003 |
| JP | 2003-346657 | A | 12/2003 |
| JP | 2005-82450 | A | 3/2005 |
| JP | 2005-180743 | A | 7/2005 |
| JP | 2005-249372 | A | 9/2005 |
| JP | 2006-21158 | A | 1/2006 |

OTHER PUBLICATIONS

Japanese language International Search Report for PCT/JP2007/052469, dated May 1, 2007.

* cited by examiner

*Primary Examiner*—Nimeshkumar D. Patel
*Assistant Examiner*—Anne M Hines
(74) *Attorney, Agent, or Firm*—RatnerPrestia

(57) ABSTRACT

In a method of manufacturing a PDP, in which a glass substrate on which a panel structure member precursor is formed is put on a setter and the panel structure member precursor is fired/solidified, the setter mainly includes a material obtained by coupling silicon carbide and silicon nitride, and a difference between a linear expansion coefficient of the setter and a linear expansion coefficient of the glass substrate is $5\times10^{-6}$/K or less.

15 Claims, 3 Drawing Sheets

METHOD OF MANUFACTURING PLASMA DISPLAY PANEL AND SETTER FOR SUBSTRATE USED THEREIN

This application is a U.S. National Phase Application of PCT International Application PCT/JP2007/052469.

TECHNICAL FIELD

The present invention relates to a method of manufacturing a plasma display panel and a setter for a substrate used in manufacturing the plasma display panel.

BACKGROUND ART

A plasma display panel (hereinafter, referred to as PDP) has a structure in which the peripheries of a front panel and a rear panel which face each other are sealed and bonded by a sealing member. A discharge gas such as neon or xenon is filled in a discharge space formed between the front panel and the rear panel. The front panel has a plurality of pairs of display electrodes including scan electrodes and sustain electrodes formed on one surface of a glass substrate in a stripe shape, and a dielectric layer and a protective layer which cover the pairs of display electrodes. Each of the pairs of display electrodes includes a transparent electrode and an auxiliary electrode which is made of metal and is formed on the transparent electrode. The rear panel has a glass substrate, address electrodes, an underlying dielectric layer, barrier ribs, and phosphor layers. The plurality of address electrodes, the underlying dielectric layer for covering the address electrodes, and three kind of phosphor layers are provided on one surface of the glass substrate. The address electrodes are formed in a stripe shape in a direction perpendicular to the pairs of display electrodes. The barrier ribs partition the discharge space for each address electrode. The phosphor layers emit light of red, green and blue and are sequentially coated in adjacent grooves between the barrier ribs.

The pairs of display electrodes and the address electrodes are perpendicular to each other and intersections therebetween become discharge cells. These discharge cells are arranged in a matrix and three discharge cells having phosphor layers of red, green and blue, which are arranged in the direction of the pairs of display electrodes, form a pixel for color display. In the PDP, a voltage is applied between the scan electrode and the address electrode and between the scan electrode and the sustain electrode to generate gas discharge. The phosphor layers excited by ultraviolet rays which occur by the gas discharge emit light. Accordingly, the PDP displays a multicolor image.

On the front glass substrate, panel structure members such as the pairs of display electrodes and the dielectric layer are formed. On the rear glass substrate, panel structure members such as the address electrodes, the underlying dielectric layer, the barrier ribs, and the phosphor layer are formed.

A method of manufacturing the front panel and the rear panel will be described. First, a precursor of a panel structure member (a panel structure member precursor) is formed on the glass substrate and a patterning process is then performed using a photolithography method or a sand blast method as necessary. The precursor of the panel structure member is a material which becomes the panel structure member by firing and solidification and is made of an organic material such as resin and an inorganic material such as ceramic or glass. The glass substrate on which the panel structure member precursor is formed is loaded on a setter and introduced into a firing oven together with the setter. The panel structure member precursor is fired and solidified to form the panel structure member on the glass substrate. By repeating the patterning and the firing and solidification of the panel structure member precursor, a plurality of panel structure members are sequentially formed to manufacture the front panel and the rear panel. The temperature of the firing oven varies depending on the panel structure member, but is generally set to a high temperature, for example, 500° C. to 600° C. Accordingly, low-expansion coefficient crystallized glass is used as the setter and high strain point glass is used as the glass substrate (See Patent Document 1, for example).

However, the setter made of low-expansion coefficient crystallized glass is repeatedly subjected to the firing/solidifying steps, the crystal of a nucleating agent is gradually precipitated. For example, in $Li_2O$—$Al_2O_3$—$SiO_2$ low-expansion coefficient crystallized glass, $Al_2Ti_2O_7$, $ZrO_2$ or the like is precipitated as a nucleus. A portion in which the crystal is precipitated as the nucleus has a density higher than that of the other portions. The setter is slightly deformed due to the density difference. As a result, in the firing/solidifying step, the glass substrate may be rubbed and scratched by the setter which is slightly deformed.

Accordingly, when predetermined numbers of firing/solidifying steps are performed, the setter is replaced and thus productivity deteriorates.

Patent Document 1; Japanese Patent Unexamined Publication No. 2003-34657

DISCLOSURE OF THE INVENTION

The present invention is a method of manufacturing a PDP, in which a glass substrate on which a panel structure member precursor is formed is put on a setter and the panel structure member precursor is fired/solidified. The setter mainly includes a material obtained by coupling silicon carbide and silicon nitride. A difference between a linear expansion coefficient of the setter and that of the glass substrate is $5\times10^{-6}$/K or less. By the method of manufacturing the PDP, the setter is not slightly deformed in the firing/solidifying step. Furthermore, since the difference between the linear expansion coefficients is small, the setter does not rub against the glass substrate and thus the glass substrate is not scratched. Accordingly, it is possible to provide a high-quality PDP. Since the exchange frequency of the setter is reduced, productivity is improved.

DETAILED DESCRIPTION OF THE INVENTION

Figure 1:
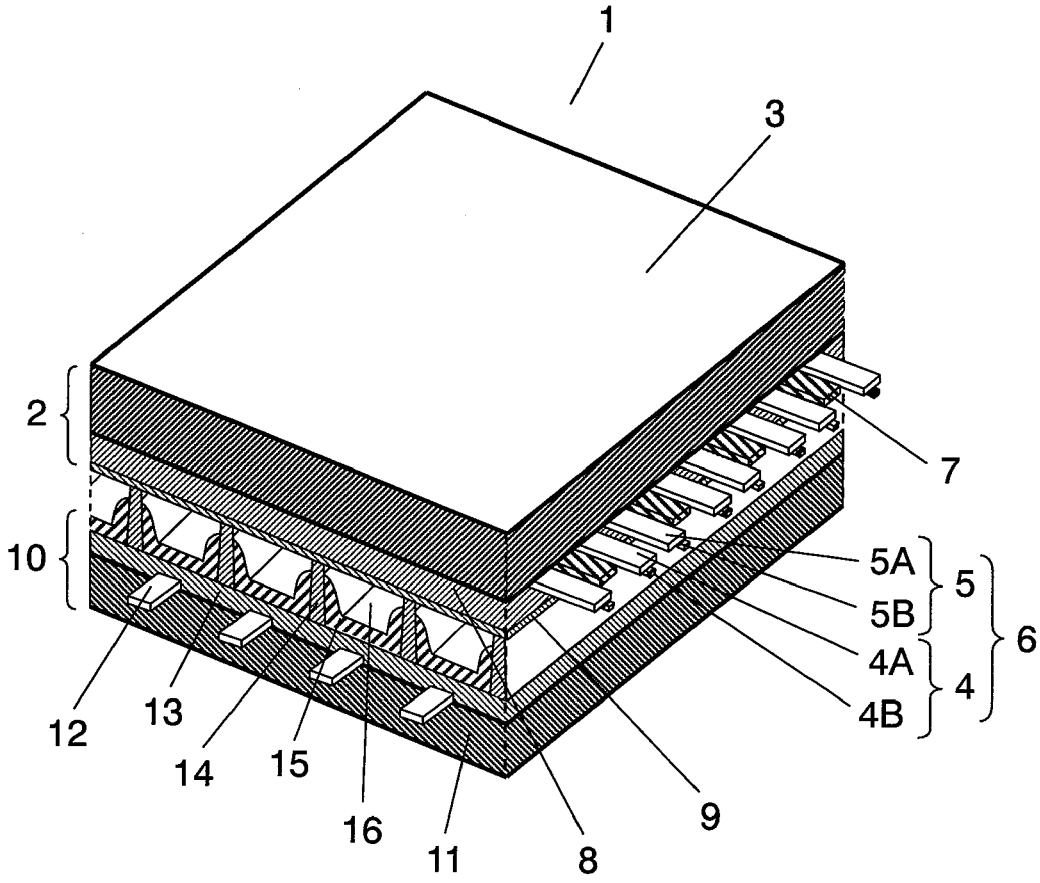
FIG. 1 is a perspective view showing the structure of a PDP manufactured by a manufacturing method according to an embodiment of the present invention.

FIG. 1 is a perspective view showing the structure of a PDP manufactured by a manufacturing method according to an embodiment of the present invention. The basic structure of PDP 1 is equal to that of a general AC surface-discharge PDP. Front plate 2 including front glass substrate 3 and rear plate 10 including rear glass substrate 11 face each other and the peripheries thereof are air-tightly sealed and bonded by a sealing member (not shown) made of glass frit. Discharge gas such as neon or xenon is filled in discharge space 16 formed in sealed PDP 1 with a pressure of 400 Torr to 600 Torr.

On one surface of front glass substrate 3, stripe-shaped display electrodes 6 and shielding layers (black stripe) 7 are arranged in plural in parallel. Stripe-shaped display electrodes 6 are composed of scan electrodes 4 and sustain electrodes 5. Dielectric layer 8 is formed so as to cover display electrodes 6 and shielding layers 7. Each scan electrode 4 includes transparent electrode 4A and metal bus electrode 4B. Each sustain electrode 5 includes transparent electrode 5A and metal bus electrode 5B. Dielectric layer 8 is made of lead borate glass or the like and functions as a capacitor. Protective layer 9 made of magnesium oxide (MgO) is formed on the surface of dielectric layer 8.

On one surface of rear glass substrate 11, stripe-shaped address electrodes 12 are arranged in a direction perpendicular to scan electrodes 4. Underlying dielectric layer 13 covers address electrodes 12. Barrier ribs 14 which partition discharge space 16 are formed on underlying dielectric layer 13 between address electrodes 12. Phosphor layers 15 of red, green and blue, which emit light by receiving ultraviolet rays, are sequentially coated in grooves between barrier ribs 14. Each Discharge cell is formed at an intersection between address electrode 12 and a pair of scan electrode 4 and sustain electrode 5.

Next, a method of manufacturing PDP 1 will be described. Front plate 2 is formed as follows. First, scan electrodes 4, sustain electrodes 5, and shielding layers 7 are formed on one surface of front glass substrate 3. Scan electrode 4 and sustain electrode 5 are composed of transparent electrodes 4A and 5A made of indium-tin-oxide (ITO), tin oxide ($SnO_2$) or the like and metal bus electrodes 4B and 5B made of silver or the like, respectively. Metal bus electrodes 4B and 5B are formed by firing and solidifying a metal bus electrode precursor formed and patterned on transparent electrodes 4A and 5A at a high temperature. At this time, a paste including silver or the like is formed on the front surface of a glass substrate and the metal bus electrode precursor is patterned by a photolithography method or a screen printing method. Similarly, shielding layer 7 is formed by firing and solidifying a shielding layer precursor which is formed by patterning a paste including a black pigment by the screen printing method or the photolithography method.

Next, a dielectric paste is coated by a die coating method so as to cover scan electrodes 4, sustain electrodes 5 and shielding layer 7 such that a dielectric precursor is formed. Thereafter, front glass substrate 3 is left at rest in order to level the surface of the dielectric precursor. After front glass substrate is left at rest, the dielectric precursor is fired and solidified to form dielectric layer 8 so as to cover scan electrodes 4, sustain electrodes 5 and shielding layer 7. The dielectric paste is a kind of paint including a dielectric material such as glass powder, a binder, and a solvent. Next, protective layer 9 made of MgO is formed on dielectric layer 8 by a vacuum deposition method. By the above steps, predetermined front panel structure members (scan electrodes 4, sustain electrodes 5, shielding layer 7, dielectric layer 8, and protective layer 9) are formed on front glass substrate 3, thereby completing front plate 2.

On the other hand, rear plate 10 is formed as follows. On one surface of rear glass substrate 11, an address electrode precursor is formed by a method of screen-printing a silver paste or a method of forming a metal film on the entire surface followed by patterning the metal film using a photolithography method. Thereafter, the address electrode precursor is fired and solidified to form address electrodes 12. Next, a dielectric paste is coated by a die coating method so as to cover address electrodes 12 such that an underlying dielectric precursor is formed. Thereafter, the underlying dielectric precursor is fired and solidified to form underlying dielectric 13. The underlying dielectric paste is a kind of paint including an underlying dielectric material such as glass powder, a binder and a solvent.

Next, a barrier rib paste including a barrier rib material is coated on underlying dielectric 13 and is patterned to a barrier rib precursor. The barrier rib precursor is fired and solidified to form barrier ribs 14. As a method of patterning the barrier rib paste, a photolithography method or a sand blast method can be used, for example.

Next, a phosphor paste including a phosphor material is coated on the side surface of barrier ribs 14 and underlying dielectric 13 between adjacent barrier ribs 14 to form a phosphor precursor. This phosphor precursor is fired and solidified to form phosphor layer 15. By the above steps, rear plate 10 having predetermined panel structure members (address electrodes 12, underlying dielectric 13, barrier ribs 14, and phosphor layer 15) is completed on rear glass substrate 11.

Front plate 2 and rear plate 10 manufactured by the above steps face each other such that scan electrodes 4 and address electrodes 12 are perpendicular to each other and the peripheries thereof are sealed and bonded by glass frit (not shown). The discharge gas including neon or xenon is filled in discharge space 16 formed between front plate 2 and rear plate 10. Accordingly, PDP 1 is completed.

As described above, when PDP 1 is manufactured, at least two firing/solidifying steps are required in manufacturing front plate 2 and four firing/solidifying steps are required in manufacturing rear plate 4 for each panel structure member. The firing/solidifying step is generally performed at a temperature of 500° C. to 600° C.

Next, a setter for a substrate of PDP (hereinafter, referred to as a substrate) used in the firing/solidifying step will be described. The setter includes a first setter which is used to put front glass substrate 3 thereon and perform the firing/solidifying step and a second setter which is used to put rear glass substrate 11 thereon and perform the firing/solidifying step. These setters are manufactured by the same manufacturing method and are used in the same way, except that the sizes thereof are different from each other due to a difference between the sizes of glass to be fired and solidified. Hereinafter, the description of setter 20 and substrate 21 indicates a combination of the first setter and front glass substrate 3 or the second setter and rear glass substrate 11.

Setter 20 mainly includes silicon composite material 19 having a silicon carbide (SiC) structure and a silicon nitride ($Si_3N_4$) structure and is manufactured as follows. First, 70 wt % of silicon carbide powder of 0.05 to 300 μm and 30 wt % of silicon powder of 0.05 to 30 μm are dispersed in water and mixed to form slurry. The slurry is poured into a plate-shaped mold having an area larger than that of front glass substrate 3 or rear glass substrate 11, and dried. The dried molded material is fired for 10 to 20 hours at 1000° C. or more and preferably 1400° C. in a nitrogen atmosphere. By firing, the silicon powder is coupled to nitrogen in the atmosphere and is converted into silicon nitride, thereby obtaining silicon composite material 19 shown in FIG. 2. By changing the compounding ratios of the silicon carbide powder and the silicon powder, it is possible to manufacture setter 20 using silicon composite material 19 having different contents of silicon carbide 17.

Figure 2:
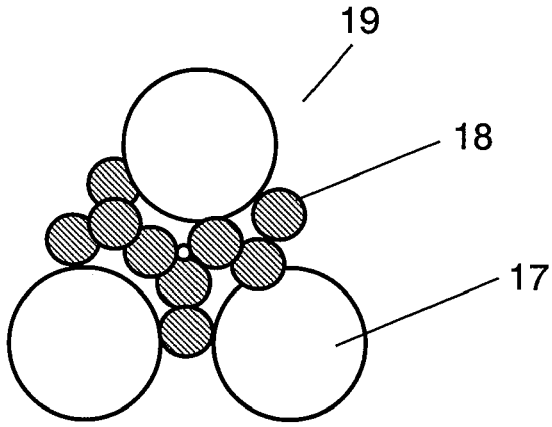
FIG. 2 is a schematic view showing a state of coupling silicon carbide and silicon nitride in a silicon composite material included in a setter according to the embodiment of the present invention.

FIG. 2 is a schematic view showing a coupling state of silicon carbide 17 and silicon nitride 18 in silicon composite material 19. Silicon nitride 18 is bonded with silicon carbide 17 so as to be stuck in between silicon carbides 17. That is, silicon composite material 19 has a structure in which silicon carbides 17 are coupled via silicon nitrides 18.

A thermal expansion coefficient of thus manufactured setter 20 is $4.5\times10^{-6}$/K, heat conductivity thereof is 30 W/m·K, Young's modulus thereof is 150 GPa, and a bending strength thereof is 100 MPa.

Figure 3A:
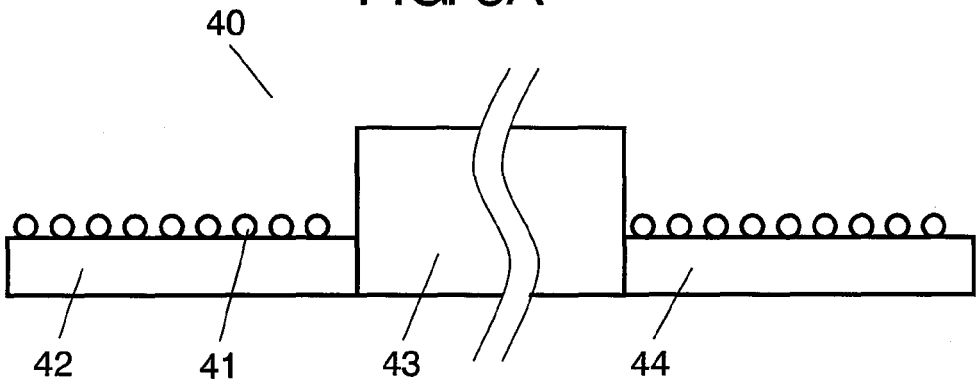
FIG. 3A is a schematic front view showing a firing/solidifying apparatus used in the present embodiment.
Figure 3B:
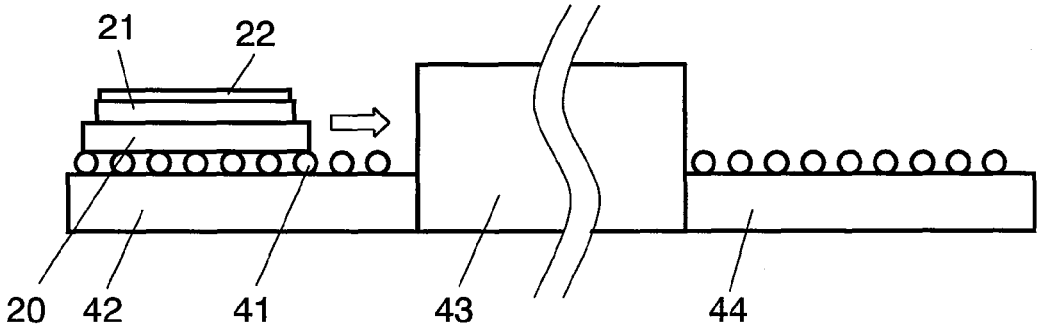
FIG. 3B is a schematic view showing a state before the firing/solidifying step is performed in FIG. 3A.
Figure 3C:
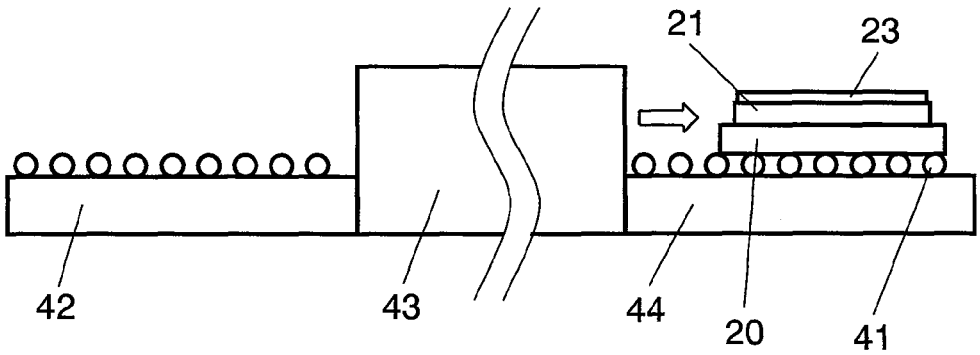
FIG. 3C is a schematic view showing a state after the firing/solidifying step is performed in FIG. 3A.

FIG. 3A is a schematic front view showing a firing/solidifying apparatus used in the present embodiment. FIG. 3B is a schematic view showing a state before firing and solidification in a step of firing and solidifying the panel member precursor using the setter in FIG. 3A. FIG. 3C is a schematic view showing a state after the firing and solidification.

As shown in FIG. 3A, firing/solidifying apparatus 40 includes panel carrying-in table 42, firing/solidifying oven 43, panel carrying-out table 44, and roller 41. Roller 41 carries setter 20 on panel carrying-in table 42 into firing/solidifying oven 43 and to panel carrying-out table 44. Firing/solidifying oven 43 heats setter 20 carried in by roller 41 with a heater.

In FIG. 3B, substrate 21 indicates front glass substrate 3 or rear glass substrate 11. Panel structure member precursor 22 indicates the front panel structure member precursor of any one of metal bus electrodes 4B or 5B, shielding layer 7, dielectric layer 8 and protective layer 9 before firing and solidification if substrate 21 is front glass substrate 3, and indicates the rear panel structure member precursor of any one of address electrodes 12, underlying dielectric layer 13, barrier ribs 14, and phosphor layers 15 before firing and solidification if substrate 21 is rear glass substrate 11. As shown in FIG. 3B, substrate 21 on which panel structure member precursor 22 is formed is put on setter 20. After putting-on, roller 41 is driven to carry setter 20 into firing/solidifying oven 43.

In FIG. 3C, panel structure member 23 indicates metal bus electrodes 4B or 5B, shielding layer 7, dielectric layer 8, and protective layer 9 if substrate 21 is front glass substrate 3 and indicates any one of address electrodes 12, underlying dielectric layer 13, barrier ribs 14, and phosphor layers 15 if substrate 21 is rear glass substrate 11. As shown in FIG. 3C, panel structure member precursor 22 formed on substrate 21 is fired and solidified by passing through firing/solidifying oven 43, thereby obtaining panel structure member 23.

Setter 20 and substrate 21 are heated at a previous stage of firing/solidifying oven 43 and are cooled at a subsequent stage thereof to be expanded or contracted according to the respective heat expansion coefficients. Since the heat expansion coefficient of substrate 21 is different from that of setter 20, the surfaces thereof are rubbed by heating or cooling. In a case where micro irregularities are formed in the surface of substrate 21 or setter 20, the surfaces of substrate 21 and setter 20 are scratched when the surfaces thereof are rubbed. The scratch in substrate 21 causes crack of substrate 21 or hinders light emission by diffused reflection of a display surface if substrate 21 is front glass substrate 3.

Figure 4:
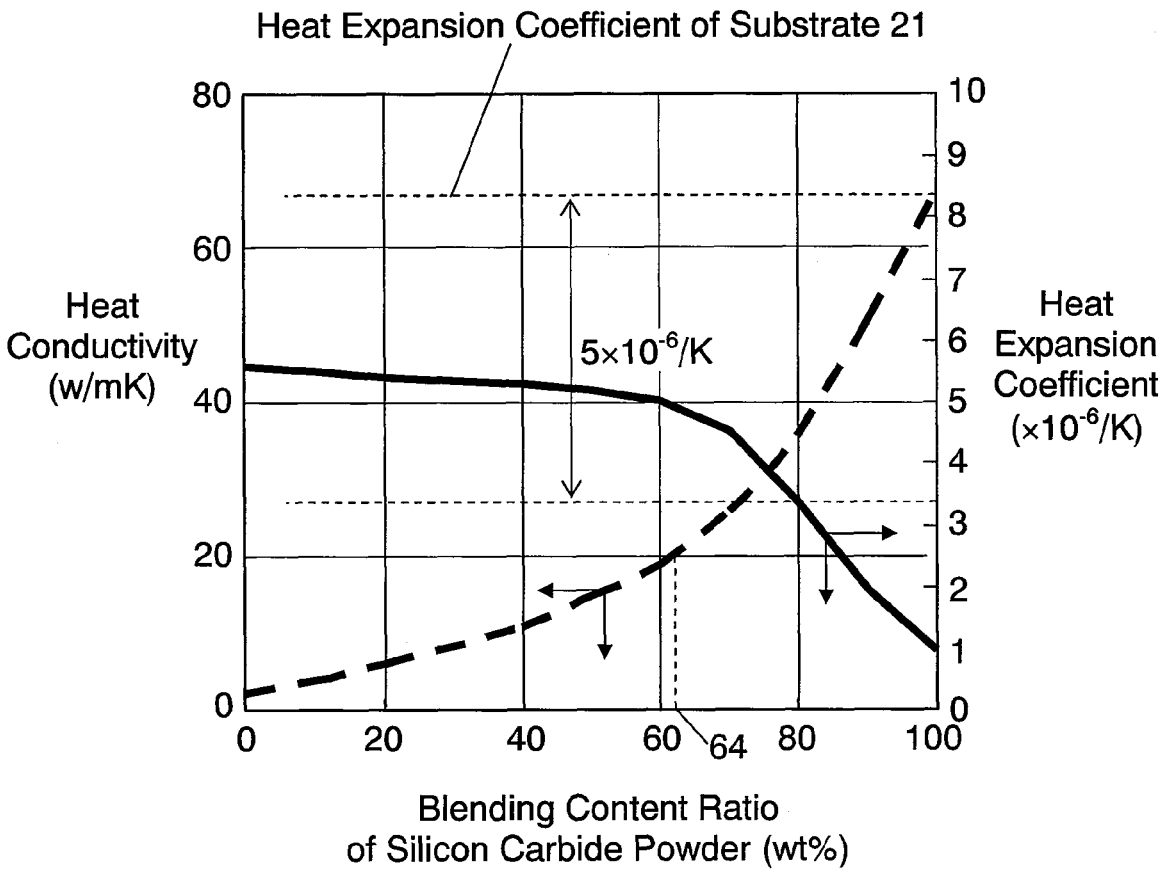
FIG. 4 is a characteristic diagram showing a relationship among the content of silicon carbide, a heat expansion coefficient, and heat conductivity in a silicon composite material configuring the setter according to the embodiment of the present invention.

FIG. 4 is a characteristic diagram showing a relationship among a heat expansion coefficient or heat conductivity and the blending content ratio of silicon carbide powder when silicon composite material 19 configuring setter 40 is fired. First, a relationship between the content of silicon carbide 17 and the heat expansion coefficient will be described. As the content of silicon carbide 17 increases, the heat expansion coefficient of silicon composite material 19 decreases. As described above, as a difference between the heat expansion coefficient of setter 20 and $8.3\times10^{-6}$/K increases, substrate 21 is apt to be scratched. The value mentioned above is the heat expansion coefficient of substrate 21. It is preferable that the length of the scratch is smaller. If the length of the scratch is less than 1 mm, the scratch cannot be easily viewed and no problem occurs in practical use. In order to reduce the length of the scratch to be less than 1 mm, the difference between the heat expansion coefficient of substrate 21 and that of setter 20 needs to be $5\times10^{-6}$/K or less. Accordingly, from FIG. 4, if the blending content ratio of the silicon carbide powder is 80 wt % or less, the length of the scratch is preferably 1 mm or less. However, more than 0 wt % of silicon carbide powder needs to be mixed to silicon composite material 19 in order to form silicon composite material 19. If the silicon carbide powder is not mixed, sufficient strength of setter 20 cannot be ensured.

Since almost all of the mixed silicon powder is converted into silicon nitride, if the blending content ratio of the silicon carbide powder is 80 wt %, the content of silicon carbide 17 contained in silicon composite material 19 after firing becomes 44.4 wt %.

When setter 20 mainly including silicon composite material 19 is manufactured, a nucleating agent such as low-expansion coefficient crystallized glass is not used as described above. Accordingly, although the firing/solidifying steps are repeatedly performed at about 600° C., crystal is not precipitated as a nucleus and setter 20 on which substrate 21 is put is unlikely to be slightly deformed. Accordingly, even in prolonged use, the effect that substrate 21 is suppressed from being scratched is maintained.

The above effect is particularly remarkable when front glass substrate 3 is used as substrate 21, but the same effect is obtained even when setter 20 including silicon composite material 19 is used as the second setter and rear glass substrate 11 is used. That is, if the difference between the heat expansion coefficients of the second setter and rear glass substrate 11 is set to $5\times10^{-6}$/K or less, that is, the content of silicon carbide 17 is set to 44.4 wt % or less, it is possible to suppress rear glass substrate 11 from being scratched.

By setting the content of silicon carbide 17 to 44.4 wt % or less, it is possible to provide setter 20 capable of manufacturing a plasma display in which glass is unlikely to be scratched and broken. Although setter 20 is repeatedly used, since the effect for suppressing the scratch is maintained, the exchange frequency of setter 20 is reduced and thus productivity is improved.

Next, a relationship between the content of silicon carbide 17 and the heat expansion coefficient will be described with respect to FIG. 4. As the content of silicon carbide 17 decreases, the heat conductivity of silicon composite material 19 decreases. If the heat conductivity of setter 20 is low, a temperature distribution occurs in substrate 21 when substrate 21 and setter 20 are cooled in the subsequent stage of firing/solidifying oven 43 and thus warpage occurs in substrate 21 due to a temperature difference between a high temperature portion and a low temperature portion. The warpage may cause the crack of substrate 21. When substrate 21 is fired and solidified using setter 20 having high heat conductivity on the other hand, the in-plane temperature of setter 20 becomes uniform in a short period although the temperature distribution occurs in setter 20. Accordingly, the warpage of substrate 21 is reduced. More specifically, it is preferable that the warpage is suppressed to twice or less of the thickness of substrate 21.

For that purpose, the heat conductivity of setter 20 is set to 20 W/mK or more. That is, it can be seen from FIG. 4 that the blending content ratio of the silicon carbide powder is 64 wt % or more. If the blending content ratio of the silicon carbide powder is 64 wt %, the content of silicon carbide 17 contained in silicon composite material 19 after firing becomes 26.3 wt %. The heat conductivity decreases as the content of silicon carbide 17 decreases. The reason why is considered that a sintering degree is reduced and thus extreme precision of silicon composite material 19 is reduced.

Accordingly, by setting the content of silicon carbide 17 to be equal to or greater than 26.3 wt %, it is possible to suppress the warpage of substrate 21 at the firing/solidifying step and to provide setter 20 capable of manufacturing a high-quality plasma display. That is, by setting the content of silicon carbide 17 at least 26.3 wt % and at most 44.4 wt %, it is possible to suppress the scratch of substrate 21 and the warpage of substrate 21.

The above effect is particularly remarkable when front glass substrate 3 is used as substrate 21, but the same effect is obtained even when setter 20 is used as a second setter and rear glass substrate 11 is used as substrate 21. That is, if the heat conductivity of the second setter is 20 W/mK or more, that is, the content of silicon carbide 17 is 26.3 wt % or more, it is possible to suppress the warpage of glass.

In the firing/solidifying step, substrate 21 and setter 20 are simultaneously heated. Thus, heat capacity of setter 20 is preferably small. Silicon composite material 19 configuring setter 20 is a ceramic material which is a porous structure. Accordingly, the heat capacity thereof is smaller than that of crystallized glass by about 20%. The heat conductivity is higher than before by about 30 times and rapidly copes with a variation in temperature in the firing/solidifying step. As a result, if setter 20 is used, input energy in the firing/solidifying step is lower than before by about 10%.

In the present embodiment, setter 20 is formed of silicon composite material 19 including silicon carbide 17 and silicon nitride 18. However, if the difference between the heat expansion coefficients of substrate 21 and setter 20 is $5\times10^{-6}$/K or less, the scratch can be less than 1 mm although other materials are used. If the heat conductivity is 20 W/mK or more, the warpage of substrate 21 can be suppressed although other materials are used.

INDUSTRIAL APPLICABILITY

According to the present invention, it is possible to provide a method of manufacturing a PDP with manufacturing cost by suppressing the exchange frequency of a setter.

The invention claimed is:

1. A method of manufacturing a plasma display panel, the method comprising:

firing and solidifying a front panel structure member precursor so as to manufacture a front panel structure member after putting a front glass substrate on a first setter, the front glass substrate being provided with the front panel structure member precursor on a surface thereof;

firing and solidifying a rear panel structure member precursor so as to manufacture a rear panel structure member after putting a rear glass substrate on a second setter, the rear glass substrate being provided with the rear panel structure member precursor on a surface thereof;

sealing and bonding peripheries of the front glass substrate and the rear glass substrate after facing the front panel structure member and the rear panel structure member; and filling discharge gas in a space formed between the front glass substrate and the rear glass substrate, wherein the first setter mainly includes a silicon composite material obtained by coupling silicon carbide and silicon nitride, and a difference between a linear expansion coefficient of the first setter and a linear expansion coefficient of the front glass substrate is at most $5\times10^{-6}$/K.

2. The method according to claim 1, wherein a content of silicon carbide of the first setter is more than 0 wt % and at most 44.4 wt %.

3. The method according to claim 2, wherein heat conductivity of the first support is at least 20 W/mK.

4. The method according to claim 1, wherein heat conductivity of the first setter is at least 20 W/mK.

5. The method according to claim 4, wherein a content of silicon carbide of the first setter is at least 26.3 wt % and at most 44.4 wt %.

6. The method according to claim 1, wherein the second setter mainly includes a material obtained by coupling silicon carbide and silicon nitride, a difference between a linear expansion coefficient of the second setter and a linear expansion coefficient of the rear glass substrate is at most $5\times10^{-6}$/K.

7. The method according to claim 6, wherein a content of silicon carbide of the second setter is more than 0 wt % and at most 44.4 wt %.

8. The method according to claim 7, wherein heat conductivity of the second support is at least 20 W/mK.

9. The method according to claim 6, wherein heat conductivity of the second setter is at least 20 W/mK.

10. The method according to claim 9, wherein a content of silicon carbide of the second setter is at least 26.3 wt % and at most 44.4 wt %.

11. A setter for a substrate of a plasma display panel, on which a glass substrate is put when the glass substrate on which a panel structure member precursor is formed is fired and solidified, the setter mainly comprising a silicon composite material obtained by coupling silicon carbide and silicon nitride, a difference between a linear expansion coefficient of the setter and a linear expansion coefficient of the glass substrate being at most $5\times10^{-6}$/K.

12. The setter according to claim 11, wherein a content of silicon carbide is more than 0 wt % and at most 44.4 wt %.

13. The support according to claim 12, wherein heat conductivity is at least 20 W/mK.

14. The setter according to claim 11, wherein heat conductivity is at least 20 W/mK.

15. The setter according to claim 14, wherein a content of silicon carbide is at least 26.3 wt % and at most 44.4 wt %.

* * * * *